United States Patent [19]

Boudin et al.

[11] 4,384,662

[45] May 24, 1983

[54] POURING MECHANISM FOR CONTROLLED FLOW

[75] Inventors: Daniel Boudin, Orleans; Jean Godat, Olivet; Alain Krzywdziak, Saint Denis en Val, all of France

[73] Assignee: Fonderie & Ateliers des Sablons, France

[21] Appl. No.: 225,689

[22] Filed: Jan. 16, 1981

[30] Foreign Application Priority Data

Jan. 24, 1980 [FR] France ..... 80 01485

[51] Int. Cl.[3] ..... B67D 3/00

[52] U.S. Cl. ..... 222/484; 220/331; 222/515; 222/517; 222/544; 222/556

[58] Field of Search ..... 222/484, 511, 512, 515, 222/517, 556, 545, 544, 559; 220/317, 331, 332

[56] References Cited

U.S. PATENT DOCUMENTS

| | | | |
|---|---|---|---|
| 1,788,181 | 1/1931 | Wolf | 222/517 |
| 2,067,658 | 1/1937 | Chapin | 220/331 |
| 2,661,119 | 12/1953 | Spiess et al. | 220/331 |

*Primary Examiner*—H. Grant Skaggs

*Attorney, Agent, or Firm*—Scully, Scott, Murphy & Presser

[57] ABSTRACT

The invention relates to a controllable flow pourer mechanism.

This pourer mechanism comprises a valve mounted on an actuating device, of such construction that in closed position, the valve is kept in fluid-tight contact upon the lip of the pourer spout and that, from this position, in a first phase, the valve slides upon the lip of the pourer spout and, in a second phase, the valve carries out a rocking movement.

The invention is applied especially to effect mixtures of liquid products.

8 Claims, 8 Drawing Figures

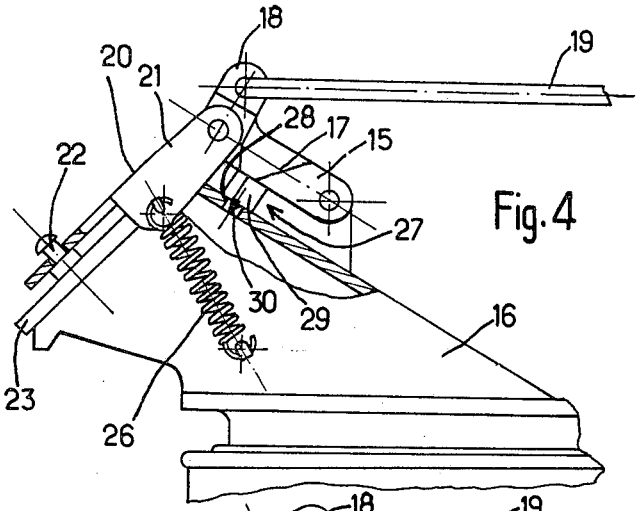
Fig. 4
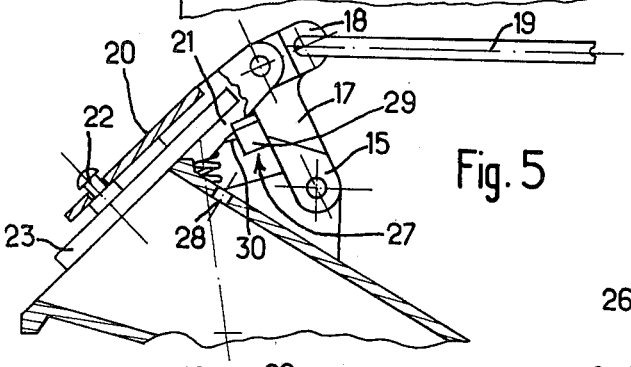
Fig. 5
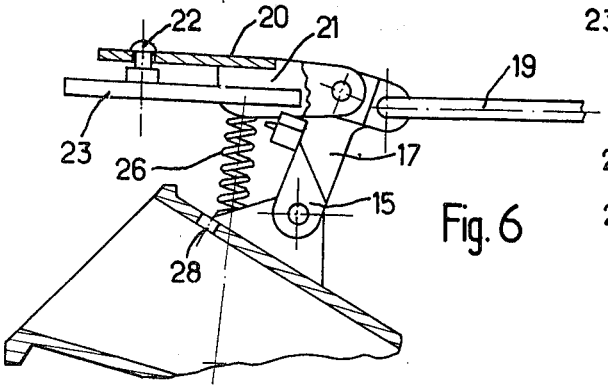
Fig. 6
Fig. 7
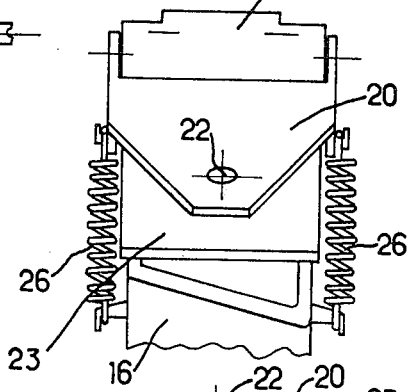
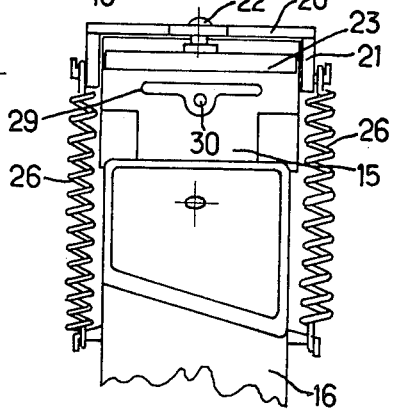
Fig. 8

POURING MECHANISM FOR CONTROLLED FLOW

BACKGROUND OF THE INVENTION

1. Field of the Invention

The present invention relates to a pouring mechanism for controllable flow especially, but not exclusively, adapted for application to lids employed with containers for base colors used in automobile factories and which are used in mixing machines.

2. Description of the Prior Art

At the present time, in pouring mechanisms of this general type, regulation of the flow is obtained by means of two principal types of valves, i.e., a valve of the "guillotine" type and a mechanism of the "clapper" type.

Guillotine type valves generally incorporate a valve element such as a closure slidably mounted over the face of the spout of the dispenser, upon which it is maintained in close-fitting contact, for example, by means of a plate-spring. This valve is caused to close (position in which it closes off the entire cross section of the pourer spout) by means of a close-coil spring and can be caused to open by means of a lever whose movement is opposed to that of said spring. To proceed with pouring or dispensing, the operator acts upon the control lever in such a way as to cause withdrawal of the valve which results in an opening whose more or less small size is a function of the position of the lever. In the case where the front of the pourer is in the shape of a dihedral neck, it is possible to obtain very exact dispensing because the triangular opening thus obtained can be sufficiently small to obtain a dropwise delivery.

On the contrary, at full opening, the freed surface is not very large so that the maximum flow of such a pouring mechanism is relatively limited.

Another drawback to this type of valve resides in the fact that it is difficult to economically achieve a good fluid-tight fit between the spout and its seating taking into account the length of the spout and its control mechanism. Furthermore, these pouring mechanisms are particularly prone to clogging.

Clapper valves use a valve element or a rocker valve, jointed upon the rear border of the pouring mechanism and furnished with an operating lever. The arrangement of this valve is such that, at rest, the valve element is maintained in fluid-tight contact upon the edge of the pouring mechanism, for example, by the action of a spring. On the other hand if an action is exerted on the lever opposed to that of the spring, a rocking towards the top of the valve is brought about and, consequently, a sectional opening increasing towards the front end of the neck, which makes a sampling possible.

This system makes it possible, therefore, to provide a relatively large opening permitting a considerable flow and a good visibility inside the tank in order to monitor the flow rate of the liquid. On the other hand, the accuracy of the dispensing which is a function of the tank's angle, depends consequently much more on the skill of the operator than in the previously described example.

In addition, this type of valve permits the instantaneous stopping of the flow through closure of the clapper, but excludes a dropwise flow, taking into account the perimeter of the neck.

SUMMARY OF THE INVENTION

The invention has for its object a controllable flow pouring mechanism which combines the advantage of the two previously described types, without entailing any of their disadvantages.

It has more particularly for its goal to obtain:

- a very progressive opening and closing allowing an exact dropwise dispensing,
- an instantaneous closure as soon as the desired quantity is reached, measured on a volumetric device or a scale.
- a good fluid-tightening on the periphery of the lid's opening,
- a great flow comparable to the one that is obtained with the total opening of the clapper,
- a good visibility inside the neck of the pourer mechanism,
- a good hold against clogging.

To obtain this result, the controllable flow pouring mechanism according to the invention comprises a valve mounted on an operating device conceived in such a way that in closed position, the valve is kept in fluid-tight contact on the edge of the pouring mechanism's spout and that, from this position, the opening lift of the valve is carried out in two successive phases, namely:

- a first phase during which the valve slides on the edge of the pouring mechanism's spout, thus progressively clearing an opening, whose maximum amplitude is a determined fraction of the pouring mechanism's spout, then, when this maximum amplitude is reached,
- a second phase during which the valve carries out a rocking movement at the end of which it completely frees the pourer spout.

According to another embodiment of the invention, the pouring mechanism according to the invention comprises a projecting nozzle on the lid and on the base of which is jointed a bent lever whose rocking can be controlled by a rod. This bent lever comprises in its free end, a hole through which can freely pass and swivel a rod bearing on its lower end a valve element and, on its upper part, an end of lift stop intended to limit the relative lift of the rod through its hole, said valve unit being submitted to the action of a spring taking support on said lever and tending to move it downwards.

Thus, in closed position, the valve element is applied on the lip of the pourer's spout due to the action of the spring.

To open the pouring element, a rocking of the bent lever is caused, for example, by means of said lever rod. Under the action of this rocking, the valve is at first carried along towards the back while staying fastened on the lip of the spout due to the action of the spring. During this movement, the valve axis slides in the hole until its end of lift stop comes to bear on the lever. From that moment the valve is lifted and rocks with the lever.

Thus there is obtained, in only one operation, the combination of effects produced by the two types of previously described valves, the first phase corresponding to the operation of the "quillotine" type valve and the second phase to the operation of the "clapper" type valve.

It is clear that in such a system, the fluid-tightness of the closing is very much improved from the fact that the spring fastens the valve uniformly upon the lip of the spout. It is therefore no longer a function, as it previously was, of the position of the axis of the clapper or of the smoothness of a spout of great length. In addition, the swivelling effect obtained between the valve axis and the bent lever makes it possible to compensate for the possible differences of parallelism.

DESCRIPTION OF THE PREFERRED EMBODIMENTS

Figure 1:
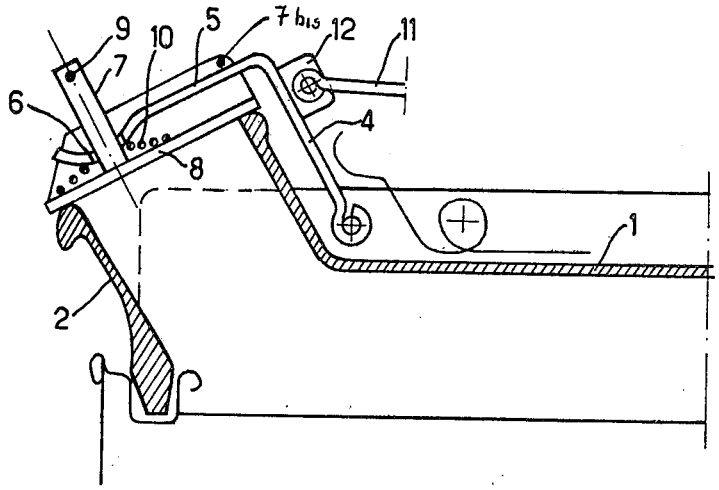
Figure 2:
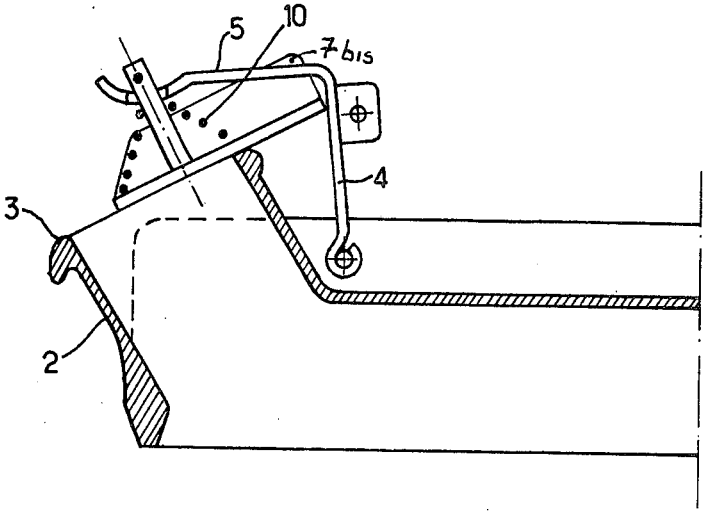
Figure 3:
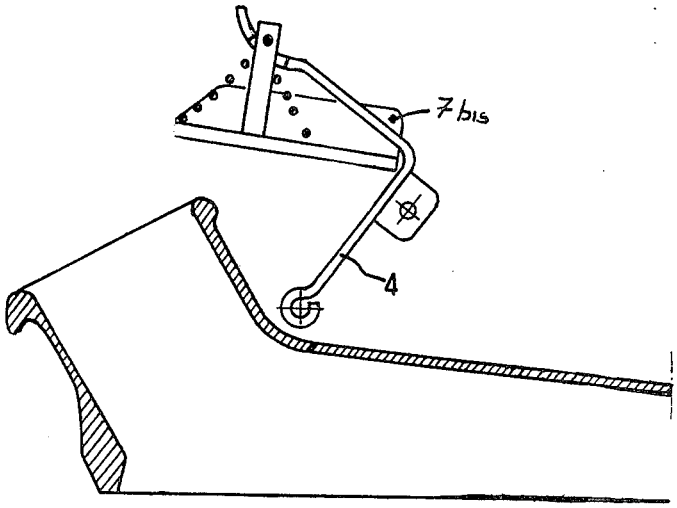

Embodiments of the invention will be described hereafter, in the way of non-limiting examples, with reference to the attached drawings in which:

FIGS. 1, 2 and 3 are three axial schematic sections of a controllable flow pouring mechanism:

in closed position, FIG. 1, at the end of the first opening phase, FIG. 2, in open position, FIG. 3;

FIGS. 4, 5 and 6 represent in axial section another embodiment of the invention:

in closed position, FIG. 4, in intermediary position, FIG. 5, and in open position, FIG. 6;

FIGS. 7 and 8 are front views of the controllable flow pouring mechanism shown in FIGS. 4, 5, 6, in intermediary position FIG. 7, and in open position FIG. 8.

As shown in the drawings, the pouring mechanism is provided together with a box lid 1 of the type used in mixing machines. It is composed of a tubular spout 2 made of the same material as lid 1 and which is preferably furnished in its front part with a dihedric neck. Lip 3 of this spout 2, which serves as a fluid-tight fit, is strictly smooth.

At the base of this spout 2, on the side situated towards the center of lid 1, is jointed a bent lever 4 able to move between a closed position, in which free arm 5 comes to extend parallel above spout 2, and an opening position in which it is totally moved away in relation to said spout 2.

Free arm 5 of lever 4 comprises, near its end, a hole 6 through which can slide and swivel a rod 7 integral, at its lower part with a valve blade 8 presenting a precisely flat lower face and which comprises, at its upper part, a split pin 9 or similar means serving as an end of lift stop holding back on one side, rod 7 fixed inside hole 6; and, moreover, two stops 7A which hold back blade 8 in a completely opened position.

This blade 8 is preferably coated with an anti-adhesive protection of the polytetrafluoroethylene type and can be also entirely fabricated with polytetrafluoroethylene.

In addition, between arm 5 of lever 4 and valve blade 8 is arranged, coaxially to rod 7, a helical spring 10 of conical form.

Movement of lever 4 can be controlled by a release mounted on the handle of the lid (not shown) through the intermediary of a control rod 11 jointed on lever 4, for example, by means of a jointed cover 12.

Therefore, in the closed position shown in FIG. 1, valve blade 8 is held fastened in a uniform way on smooth lip 3 of spout 2, by the action of spring 10, control rod 11 prohibiting therefore any movement of lever 4.

From this position, opening of the pourer mechanism is obtained upon carrying out a pull on rod 11, so as to make lever 4 move.

At the beginning of this movement, lever 4 will carry out, through the intermediary of rod 7, a pull towards the back of valve blade 8, which remains fastened on lip 3 of spout 2 by the action of spring 10. During this movement, the end of arm 5 rises in relation to rod 7 until coming to a stop on pin 9 (FIG. 2). From that moment, arm 5 in continuing its movement, lifts up the unit formed by valve blade 8 and spring 10 and moves it away laterally in relation to spout 2, until it reaches the open position represented in FIG. 3, the blade resting on stops 7A.

Referring to FIGS. 4 to 8, which represent an embodiment derived from the one previously described, the controllable flow pouring mechanism comprises a straight lever 15, jointed at the base of spout 16 and which comprises near its free end, two lateral protuberances 17 as well as a jointed piece 18 in which control rod 19 comes to pivot. On this free end, comes also to be jointed a cap 20 furnished with two lateral edges 21 which, in a closed position, comes to extend above the opening of spout 16.

In the front part of this cap 20, comes to be jointed, by means of a pivot 22 made up by a riveted centerpoint or a stop retaining ring, a fluid-tight blade 23, for example, of polytetrafluoroethylene. Cap 20 is furthermore submitted to the action of two lateral springs 26 respectively fixed, to each of their ends, at the base of spout 16 and on lateral edges 21. The position of these springs 26 is more particularly arranged so that they exercise, in a closed position or partially closed position of the pourer element, a plating pressure of blade 23 on spout 16 as well as a return pressure tending to reclose blade 23, and during the end of the opening lift, a weaker valve force component in the direction of closing, which lessens the effort the operator must produce on the release.

Straight lever 15 comprises in addition, on the side of spout 16, a hammer means 27 intended to open an air-inlet hole 28 provided in spout 16, in the event where this hole would be clogged up by dry paint. This device proves itself necessary because in the case where hole 28 is sealed, it is found that the rate of flow is carried out in jerks when the device is used with a small opening.

It will be noted that this hammer means 27 comprising a base 29 terminated by a point 30, serves at the same time as a stop to blade 23 when the pourer mechanism is in an entirely open position.

The operation of the previously described pourer mechanism is therefore the following:

In closed position (FIG. 4) the fluid-tight blade is firmly applied against the lip of spout 16 by the action of draw-spring 26. Owing to the swivel effect obtained by pivot 22, the possible differences of parallelism are compensated and the blade is firmly applied on the lip of spout 16.

The opening of the pourer element is obtained in pulling on lever 15 by means of control rod 19. During a first phase, FIGS. 5 and 7, this pulling causes a movement towards the rear of cap 20 as well as fluid-tight blade 23 which remains in tight contact with the lip of spout 16, owing to the action of spring 26 and the relative angular working of cap 20-blade 23 due to the swivel effect obtained by pivot 22.

This process is continued until the lateral edges 21 of cap 20 come into contact with the lateral protuberances 17 of lever 15. From that moment, cap 20 and fluid-tight blade 23 move integrally with lever 15 after the fashion of a clapper (FIGS. 6 and 8).

It will be noted that straight lever 15 could comprise, in place of jointed piece 18, a lever-arm upon which an operator can press to cause the opening of the pourer element.

What is claimed is:

1. A controllable flow pourer mechanism comprising, a vessel having a closable orifice, a closure element (8), means for actuating the pourer mechanism comprising a lever (4) supporting said closure element, means for pivoting said lever on a wall of the vessel, a moveable joint between said lever and said closure element, said moveable joint providing for a sliding and pivoting movement of said closure element relative to said lever, a biasing means for biasing said closure element against said closable orifice, and stop means (9) for blocking the angular position of said closure element relative to said pivoting lever at the end of the opening of said closure element.

2. A controllable flow pourer mechanism, comprising:

a. a pourer spout projecting from a base, said pourer spout defining a pourer mouth with a lip therearound;

b. a valve element mounted relative to said pourer spout to maintain a fluid-tight contact seal with said lip; and c. means for mounting said valve element relative to said pourer spout such that, during opening, the valve element is withdrawn from said pourer mouth in a first phase movement during which said valve element slides on said lip of the pourer spout to progressively clear said pourer mouth to an opening, the maximum area of which is a predetermined fraction of the area of the pourer mouth, and a second phase movement, after said maximum area is reached, during which said valve element is pivotally moved to completely open and free said pourer mouth, said mounting means including a bent lever pivoted at said spout base, the movement of said bent lever being controlled by a rod, said bent lever comprising in its free end a hole through which freely passes and swivels a rod bearing, at its lower end, said valve element, and at its upper part an end of a lift stop to limit the relative stroke of the rod through its hole, and a spring supported on said lever and biasing it downwardly.

3. Pourer mechanism according to claim 2, wherein said spring is cone-shaped helical spring.

4. Pourer mechanism according to claim 1 or 2 or 3, wherein said closure or valve element includes a blade coated with an antisticking material.

5. Pourer mechanism according to claim 4, said antisticking material comprising polytetrafluoroethylene.

6. A controllable flow pourer mechanism, comprising:

a. a pourer spout defining a pourer mouth with a lip therearound;

b. a valve element mounted relative to said pourer spout to maintain a fluid-tight contact seal with said lip; and c. means for mounting said valve element relative to said pourer spout such that, during opening, the valve element is withdrawn from said pourer mouth in a first phase movement during which said valve element slides on said lip of the pourer spout to progressively clear said pourer mouth to an opening, the maximum area of which is a predetermined fraction of the area of the pourer mouth, and a second phase movement, after said maximum area is reached, during which said valve element is pivotally moved to completely open and free said pourer mouth, said mounting means including a straight lever pivoted at said spout base and having, near its free end, two lateral protuberances and a jointed piece in which a jointed rod pivots, said free end pivotally mounting a cap having two lateral edges which, in a closed position, extend above the opening of the pourer mouth, a fluid-tight blade pivoted in the front of said cap comprised of polytetrafluoroethylene material, said cap being biased at closing by two lateral springs respectively fixed at each of their ends, to said spout base and said lateral edges.

7. Pourer element according to claim 6, wherein said straight lever additionally comprises a hammer means for opening an air inlet hole provided in the spout.

8. A controllable flow pourer mechanism, comprising:

a. a pourer spout defining a pourer mouth with a lip therearound;

b. a valve element mounted relative to said pourer spout to maintain a fluid-tight contact seal with said lip; and c. means for mounting said valve element relative to said pourer spout such that, during opening, the valve element is withdrawn from said pourer mouth in a first phase movement during which said valve element slides on said lip of the pourer spout to progressively clear said pourer mouth to an opening, the maximum area of which is a predetermined fraction of the area of the pourer mouth, and a second phase movement, after said maximum area is reached, during which said valve element is pivotally moved to completely open and free said pourer mouth, said mounting means including a straight lever pivoted at said spout base and having, near its free end, two lateral protuberances and a lever arm, which can be depressed to cause the opening of the pourer element, in which a jointed rod pivots, said free end pivotally mounting a cap having two lateral edges which, in a closed position, extend above the opening of the pourer mouth, a fluid-tight blade pivoted in the front of said cap comprised of polytetrafluoroethylene material, said cap being biased at closing by two lateral springs respectively fixed at each of their ends, to said spout base and said lateral edges.

* * * * *